US009615661B1

(12) United States Patent
Hildebrand

(10) Patent No.: US 9,615,661 B1
(45) Date of Patent: Apr. 11, 2017

(54) MULTI LEVEL RACK APPARATUS HAVING INTERSECTING ARMS

(71) Applicant: Steven Hildebrand, Kindred, ND (US)

(72) Inventor: Steven Hildebrand, Kindred, ND (US)

( * ) Notice: Subject to any disclaimer, the term of this patent is extended or adjusted under 35 U.S.C. 154(b) by 0 days.

(21) Appl. No.: 15/232,748

(22) Filed: Aug. 9, 2016

(51) Int. Cl.
*A47F 1/04* (2006.01)
*A47F 7/00* (2006.01)
*A47B 81/00* (2006.01)
*A47B 47/00* (2006.01)

(52) U.S. Cl.
CPC ..... *A47B 81/005* (2013.01); *A47B 47/00* (2013.01)

(58) Field of Classification Search
CPC ..... A47B 81/005; A47F 7/0028
See application file for complete search history.

(56) References Cited

U.S. PATENT DOCUMENTS 318,336 A * 5/1885 Weidner ..... A47K 1/09 211/200
331,011 A * 11/1885 Thompson ..... B25H 3/04 211/70.6
712,428 A * 10/1902 Whitcomb ..... A47B 81/005 211/64
1,302,267 A * 4/1919 Zink ..... F41A 23/18 211/64
1,757,600 A * 5/1930 Sprowle ..... A47B 81/005 211/4
2,815,863 A * 12/1957 Larson ..... A47B 81/007 211/70.1
D185,807 S * 8/1959 Antle ..... 211/60.1
3,938,665 A * 2/1976 Rumble ..... A47F 3/10 211/163
4,143,194 A 3/1979 Wihksne
4,361,614 A 11/1982 Moffitt
4,399,176 A 8/1983 Bell et al.
4,534,471 A * 8/1985 Zahn ..... B41K 1/58 211/163
4,641,755 A * 2/1987 Oliver ..... F42B 39/28 206/3
4,688,685 A * 8/1987 Brace ..... A63C 11/028 211/60.1
4,807,763 A * 2/1989 Jankovsky ..... A47G 25/12 211/196

(Continued)

FOREIGN PATENT DOCUMENTS

DE 29510665 U1 * 9/1995 ..... A47B 43/00

*Primary Examiner* — Daniel J Troy
*Assistant Examiner* — Kimberley S Wright
(74) *Attorney, Agent, or Firm* — The Keys Law Firm PLLC

(57) ABSTRACT

A multi level rack apparatus for holding elongated items upright for storage includes a rack frame having an "X" shaped profile defined by four arms which extend out from a center portion. A structural exterior is formed from a top support level, an side wall, and a base support level, and extends across each of the arms. Disposed inside the rack frame is a lower support level which is parallel to and positioned between the top support level and base support level and a vertical support post which helps maintain the relative position of the support levels from the center portion. A plurality of sets of holding sections are disposed in each of the support levels, with each set aligned between the support levels such that an elongated item can be held upright in place by one set of holding sections.

1 Claim, 2 Drawing Sheets

(56) References Cited

U.S. PATENT DOCUMENTS 4,966,288 A * 10/1990 Kirkham ..... B25H 5/00 211/13.1
5,029,707 A * 7/1991 Feng ..... B25H 3/022 206/374
5,039,052 A * 8/1991 Carafice ..... A47B 81/005 248/156
5,154,961 A 10/1992 Reuben
5,207,321 A * 5/1993 Jones ..... A47B 73/00 206/223
5,224,602 A * 7/1993 Bettles ..... A63B 71/0045 206/315.1
5,244,700 A * 9/1993 Banschick ..... A01G 5/04 211/13.1
D342,774 S * 12/1993 McCumbers ..... D22/115
5,362,544 A 11/1994 Reuben
5,620,546 A 4/1997 Reuben
D379,881 S * 6/1997 Gregg, III ..... D6/681.3
5,643,139 A 7/1997 Stout et al.
5,657,883 A * 8/1997 Badia ..... A47B 81/005 211/60.1
5,678,348 A * 10/1997 Zielinski ..... A01K 97/08 211/70.8
5,772,050 A * 6/1998 Shih ..... B41K 1/58 211/163
5,815,995 A 10/1998 Adam
5,919,540 A 7/1999 Bailey
6,047,491 A * 4/2000 De Busk ..... A01K 97/08 206/315.11
D426,282 S * 6/2000 Harmon ..... D22/147
6,114,014 A 9/2000 Ikeda et al.
6,250,480 B1 * 6/2001 McGuinness ..... A47B 81/005 211/70.6
6,360,902 B1 * 3/2002 Searles ..... A47B 81/005 211/70.8
6,382,350 B1 5/2002 Jezewski et al.
6,398,045 B1 * 6/2002 Chao ..... H05K 13/0069 211/41.17
7,036,668 B2 * 5/2006 Udy ..... B25H 3/04 211/60.1
7,937,883 B2 * 5/2011 Roemer ..... A01K 97/10 248/512
9,198,511 B2 * 12/2015 Pendleton ..... A47B 81/005
9,282,817 B2 * 3/2016 Yates ..... A47B 81/005
2005/0252871 A1 * 11/2005 Le Roux ..... B25H 3/04 211/70.6
2006/0246255 A1 11/2006 Bailey et al.
2011/0220599 A1 * 9/2011 Siahpush ..... A47F 5/02 211/85.4
2014/0345507 A1 * 11/2014 Pendleton ..... A47B 81/005 109/48
2015/0216301 A1 * 8/2015 Yates ..... A47B 81/005 211/70.8

* cited by examiner

MULTI LEVEL RACK APPARATUS HAVING INTERSECTING ARMS

BACKGROUND OF THE INVENTION

Field of the Invention

This invention relates generally to storage devices and, more particularly, to a multi level cross shaped rack apparatus having intersecting arms of equal length.

Description of the Prior Art

The use of storage devices, such as racks and stands, to hold elongated items in an upright position for storage is well known. A problem which still exists, however, is that many conventional racks or stands offer a limited amount of storage space relative to the size of the device due to their linear or circular shape. Thus, there remains a need for a multi level rack apparatus that provides four storage arms which extend radially from a center portion. It would be helpful if such a multi level rack apparatus included a plurality of levels to allow it to securely hold items upright. It would be additionally desirable for such a multi level rack apparatus to include an integrated handle to allow the apparatus to be repositioned even while holding items.

The Applicant's invention described herein provides for a multi level rack apparatus adapted to hold elongated items across a plurality of levels in one of four radial arms. The primary components in Applicant's multi level rack apparatus are a rack frame and a handle. When in operation, the multi level rack apparatus enables more effective and efficient storage of elongated items. As a result, many of the limitations imposed by prior art structures are removed.

SUMMARY OF THE INVENTION

A multi level rack apparatus for holding elongated items upright for storage. The multi level rack apparatus comprises a rack frame having an "X" shaped profile defined by four arms which extend out from a center portion. Across each of the arms is the same continuous exterior that defines the structural exterior of the rack frame. The structural exterior is formed from a top support level, an side wall, and a base support level. Disposed inside the rack frame is a lower support level which is parallel to and positioned between the top support level and base support level and a vertical support post which helps maintain the relative position of the support levels from the center portion. A plurality of sets of holding sections are disposed in each of the support levels, with each set aligned between the support levels such that an elongated item can be held upright in place by one set of holding sections.

It is an object of this invention to provide a multi level rack apparatus that employs four storage arms which extend radially from a center portion.

It is another object of this invention to provide a multi level rack apparatus that includes a plurality of levels to allow it to securely hold items upright.

It is yet another object of this invention to provide a multi level rack apparatus that includes an integrated handle to allow the apparatus to be repositioned even while holding items.

These and other objects will be apparent to one of skill in the art.

DETAILED DESCRIPTION OF THE INVENTION

Figure 1:
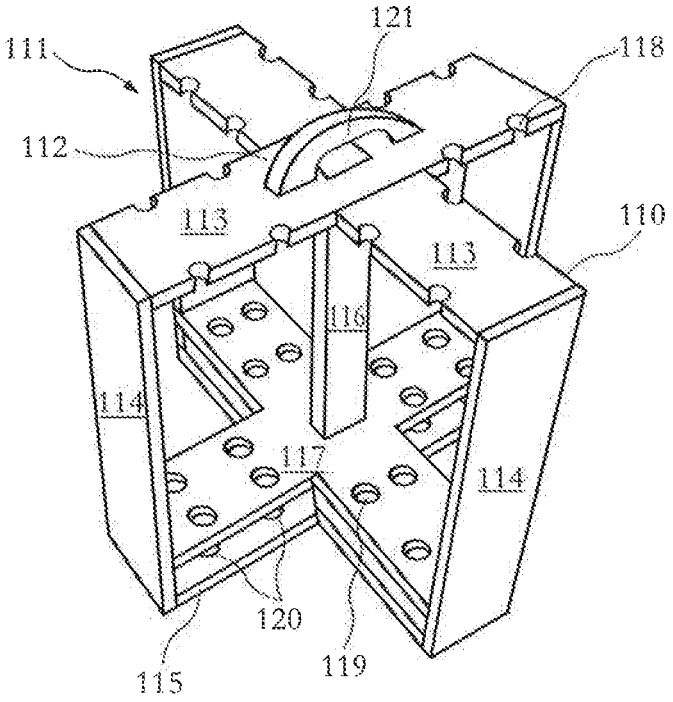
FIG. 1 is a side perspective view of a multi level rack apparatus built in accordance with the present invention.
Figure 2:
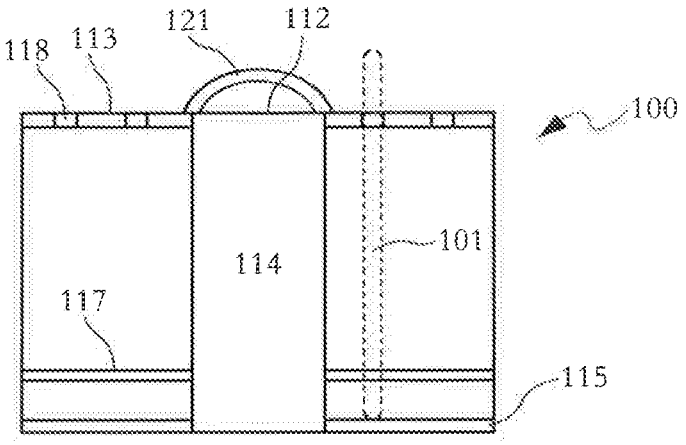
FIG. 2 is a front elevational view of a multi level rack apparatus built in accordance with the present invention.
Figure 3:
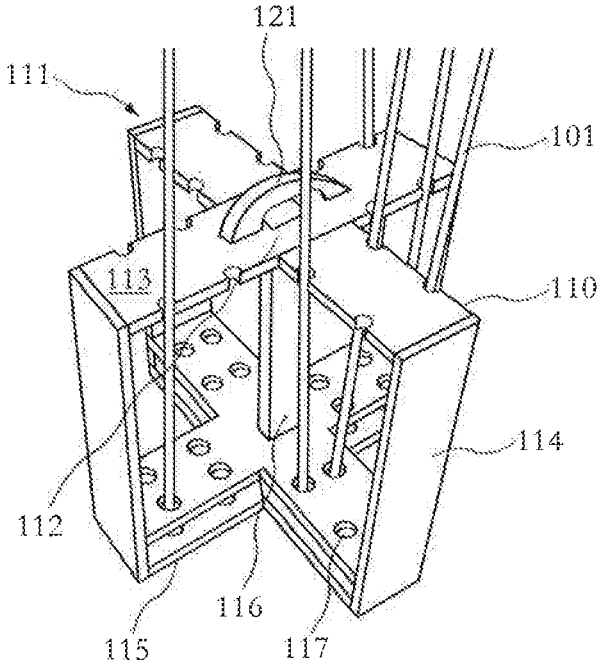
FIG. 3 is a side perspective view of a multi level rack apparatus built in accordance with the present invention with a plurality of items stored thereon.

Referring now to the drawings and in particular FIGS. 1, 2, and 3, a multi level rack apparatus 100 is shown having a rack frame 110 having an "X" shaped profile and formed from four arms 111 which extend out from a center portion 112. In the illustrated embodiment, each arm 111 is perpendicular to the other arms 111 to which it is adjacent. Extending from the center portion 112 and across each of the arms 111 is a continuous exterior formed from a top support level 113, an side wall 114, and a base support level 115. This continuous exterior defines the structural exterior of the rack frame 110.

Inside the rack frame 110 is a vertical support post 116 positioned in the center portion 112 and a lower support level 117 which is parallel to the top support level 113 and base support level 115 and positioned between these support levels 113, 115. The support post 116 provides a central support which helps maintain the relative position of the top support level 113, lower support level 117, and base support level 115, while the lower support level 117 operates to prevent items positioned to extend between the top support level 113 and base support level 115 from tipping over.

A plurality of sets of holding sections are disposed on the top support level 113, lower support level 117, and base support level 115 of each arm 111. Each set of holding sections includes a holding notch 118 in the top support level 113, a holding aperture 119 in the lower support level 117, and a holding basin 120 in the base support level 115. For each set of holding sections, the holding notch 118, holding aperture 119, and holding basin 120 are aligned vertically so that an elongated item 101 can be slid into the holding aperture 119 until its bottom rests in the holding basin 120, with its upper section then positioned in the holding notch 118 (as illustrated in FIG. 3). In this regard, the holding notch 118, holding aperture 119, and holding basin 120 configures the top support level 113, lower support level 117, and base support level 115 to hold an elongated item 101 upright.

In one embodiment, a handle member 121 is fixed to the top support level 113, extending over the support post 116, to provide a handling structure to allow for moving or repositioning the a multi level rack apparatus 100.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A multi level rack apparatus for holding elongated items upright, comprising:

a rack frame having an "X" shaped profile and four arms which extend out from a center portion, wherein said rack frame includes a top support level forming a top surface, a base support level forming a bottom surface, and a lower support level which is parallel to and positioned between the top support level and base support level;

a plurality of sets of holding sections disposed on said rack frame, wherein each set of holding sections defines a top holding portion defining a notch in said top support level, a base holding portion defining a basin in said base support level, and a lower holding portion defining an aperture in said lower support level;

a support post is positioned in the center portion, extending between the top support level and base support level;

a handling member integral with said top support level and positioned over the support post;

wherein the top holding portion, base holding portion, and lower holding portion in each set are vertically aligned so as to cause an elongated item that engages the top holding portion, base holding portion, and lower holding portion of the same set to be positioned upright;

wherein said each arm includes a side wall at the arm's distal-most end relative to the center portion, extending between the top support level and base support level.

* * * * *